US010370920B2

(12) United States Patent
Hansen et al.

(10) Patent No.: US 10,370,920 B2
(45) Date of Patent: Aug. 6, 2019

(54) WELLBORE INTERVENTION TOOL FOR PENETRATING OBSTRUCTIONS IN A WELLBORE

(71) Applicant: AARBAKKE INNOVATION A.S., Bryne (NO)

(72) Inventors: Henning Hansen, Dolores (ES); Tarald Gudmestad, Naerbo (NO)

(73) Assignee: AARBAKKE INNOVATION AS, Bryne (NO)

( * ) Notice: Subject to any disclaimer, the term of this patent is extended or adjusted under 35 U.S.C. 154(b) by 55 days.

(21) Appl. No.: 15/326,057

(22) PCT Filed: Jul. 14, 2015

(86) PCT No.: PCT/US2015/040455

§ 371 (c)(1),
(2) Date: Jan. 13, 2017

(87) PCT Pub. No.: WO2016/011085

PCT Pub. Date: Jan. 21, 2016

(65) Prior Publication Data

US 2017/0198538 A1 Jul. 13, 2017

Related U.S. Application Data

(60) Provisional application No. 62/024,074, filed on Jul. 14, 2014.

(51) Int. Cl.
*E21B 29/00* (2006.01)
*E21B 37/02* (2006.01)
(Continued)

(52) U.S. Cl.
CPC ..... *E21B 29/002* (2013.01); *E21B 17/003* (2013.01); *E21B 17/10* (2013.01);
(Continued)

(58) Field of Classification Search
CPC ..... E21B 29/00; E21B 29/002; E21B 29/005; E21B 29/06; E21B 29/10; E21B 31/002; E21B 37/00; E21B 37/02; E21B 17/006
See application file for complete search history.

(56) References Cited

U.S. PATENT DOCUMENTS 4,389,765 A 6/1983 Thompson, Jr.
4,809,775 A 3/1989 Fortin
(Continued)

FOREIGN PATENT DOCUMENTS

GB 1091030 A 11/1967
GB 2448919 A 11/2008
(Continued)

OTHER PUBLICATIONS

IP Australia, Examination Report No. 1 for Australian Application No. 2015289775, Sep. 13, 2017.
(Continued)

*Primary Examiner* — Brad Harcourt
*Assistant Examiner* — David Carroll
(74) *Attorney, Agent, or Firm* — Richard A. Fagin

(57) ABSTRACT

A wellbore intervention tool for use in penetrating an obstruction in a wellbore includes a cutting tool having at least one rotating cutter member for penetrating the obstruction. A displacement mechanism coupled to the cutting tool sets and adjusts a cutting position of the cutting tool relative to a tool axis. A sweeper coupled to the displacement mechanism deflects the displacement mechanism about the tool axis, and the cutting tool is deflected with the displacement mechanism.

20 Claims, 3 Drawing Sheets

(51) Int. Cl.

| | |
|---|---|
| ***E21B 23/01*** | (2006.01) |
| ***E21B 17/00*** | (2006.01) |
| ***E21B 17/10*** | (2006.01) |

(52) U.S. Cl.

CPC ..... *E21B 23/01* (2013.01); *E21B 29/005* (2013.01); *E21B 37/02* (2013.01)

(56) References Cited

U.S. PATENT DOCUMENTS

| | | | | |
|---|---|---|---|---|
| 4,817,725 | A | 4/1989 | Jenkins | |
| 7,309,194 | B2 | 12/2007 | Keefe et al. | |
| 7,478,982 | B2 | 1/2009 | Fuhst et al. | |
| 7,575,056 | B2 | 8/2009 | Fuhst et al. | |
| 8,171,988 | B2 | 5/2012 | Hallundbaek et al. | |
| 2005/0133224 | A1 | 6/2005 | Ruttley | |
| 2006/0231258 | A1* | 10/2006 | Head | E21B 7/067 166/298 |
| 2007/0205022 | A1 | 9/2007 | Treviranus et al. | |
| 2008/0092356 | A1* | 4/2008 | Fuhst | B23D 21/14 29/56.5 |
| 2010/0038080 | A1* | 2/2010 | McAfee | E21B 29/005 166/255.1 |
| 2011/0220357 | A1 | 9/2011 | Segura et al. | |
| 2013/0048329 | A1* | 2/2013 | Qian | B23D 45/10 173/214 |
| 2015/0211314 | A1* | 7/2015 | McAfee | E21B 29/005 166/250.01 |

FOREIGN PATENT DOCUMENTS

| | | | |
|---|---|---|---|
| RU | 2209917 | C1 | 8/2003 |
| RU | 96168 | U1 | 7/2010 |
| RU | 111882 | U2 | 12/2011 |
| WO | 9604457 | A1 | 2/1996 |
| WO | 9964715 | A1 | 12/1999 |
| WO | 2010123375 | | 10/2010 |
| WO | 2012083016 | A2 | 6/2012 |

OTHER PUBLICATIONS

IP Australia, Examination Report No. 2 for Australian Application No. 2015289775, Dec. 7, 2017.

Federal Service for Intellectual Property Search Report, Registration No. 2017104162/03(007287).

Communication pursuant to Article 94(3) EPC, International Application No. 15 821 565.7-1002.

* cited by examiner

WELLBORE INTERVENTION TOOL FOR PENETRATING OBSTRUCTIONS IN A WELLBORE

BACKGROUND

This disclosure relates to apparatus for penetrating wellbore obstructions. Such obstructions may be, for example, a collapsed wellbore section, a wellbore plug, a failed flapper in a downhole safety valve, and the like. The disclosure also relates to removing a section of wellbore conduit ("tubular") or penetrating several nested wellbore tubulars to access the wellbore externally to or off such tubulars.

In the hydrocarbon exploitation industry, there is often a need for penetrating an obstruction in a wellbore, where such an obstruction may be a section of a collapsed wellbore and tubulars, a "fish" in the wellbore that cannot be removed by traditional wellbore milling tools, and the like. Such a "fish" may be a barrier installed, for example, in the form of a wireline plug, a failed flapper in a downhole safety valve, a lost tool string, a logging tool, and so forth. Penetrating such obstructions can be required to bring the well back to normal operation or to obtain access to the wellbore below the obstruction to plug and abandon the well.

It is common, with various rates of success, to remove or penetrate such wellbore obstructions using lightweight wellbore milling tools deployed by wireline or coiled tubing. In some instances, attempts may be made to remove or penetrate the obstruction with heavier intervention apparatus deployed on jointed pipe; however, such methods are without guaranteed success.

Hence, there is a need for methods and devices that can be used to mechanically mill away, or to disintegrate, an obstruction sufficiently for this obstruction to fall into the wellbore below an interval of interest or to be retrieved to the surface.

SUMMARY

In one illustrative embodiment, a wellbore intervention tool for use in penetrating an obstruction in a wellbore includes a cutting tool having at least one rotating cutter member for penetrating the obstruction. The wellbore intervention tool includes a displacement mechanism that is coupled to the cutting tool and operable to set and adjust a cutting position of the cutting tool relative to a tool axis. The wellbore intervention tool includes a sweeper coupled to the displacement mechanism. The sweeper is operable to deflect the displacement mechanism about the tool axis, wherein the cutting tool is deflected with the displacement mechanism.

In another illustrative embodiment, a method of penetrating an obstruction in a wellbore includes lowering a wellbore intervention tool into the wellbore. The wellbore intervention tool includes a cutting tool having at least one rotating cutter member, a displacement mechanism coupled to the cutting tool, and a sweeper coupled to the displacement mechanism. The method includes positioning the at least one rotating cutter member against the obstruction and rotating the rotating cutter member. The method further includes operating the sweeper to deflect the displacement mechanism about the tool axis during at least a portion of rotating the rotating cutter member, thereby deflecting the rotating cutter member about the tool axis.

BRIEF DESCRIPTION OF THE DRAWINGS

The following is a description of the figures in the accompanying drawings. The figures are not necessarily to scale, and certain features and certain views of the figures may be shown exaggerated in scale or in schematic in the interest of clarity and conciseness.

DETAILED DESCRIPTION

Figure 1:
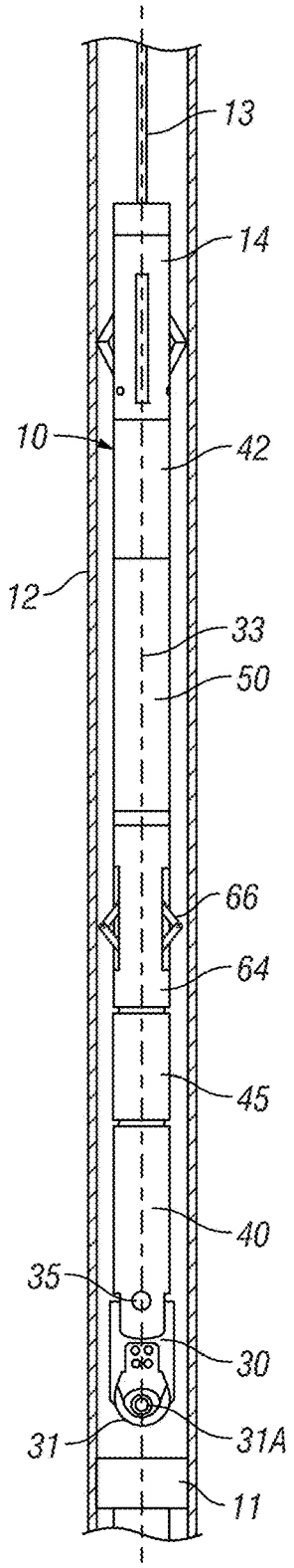
FIG. 1 shows a wellbore intervention tool for penetrating an obstruction in a wellbore according to one embodiment.

FIG. 1 illustrates a wellbore intervention tool 10 disposed within a wellbore 12 to penetrate an obstruction 11 in the wellbore 12. Herein, the term "obstruction" may generally mean any form of unwanted wellbore restriction. As discussed in the Background section herein, examples of obstructions include, but are not limited to, a section of a collapsed wellbore, a section of tubulars, and a fish, e.g., a wireline plug, a failed flapper in a downhole safety valve, a lost tool string, and the like. For the purposes of the present disclosure, an obstruction is illustrated in general form by reference numeral 11 in FIG. 1.

In one embodiment, the wellbore intervention tool 10 may be deployed into the wellbore 12 by a wellbore deployment system capable of transmitting power and control signals to the wellbore intervention tool 10 from the surface and returning data from the wellbore intervention tool 10 to the surface. For example, the wellbore intervention tool 10 may be deployed on the end of an armored electrical cable ("wireline") or a coiled tubing having an electrical cable implemented therein. As an example, FIG. 1 shows the wellbore intervention tool 10 deployed on the end of a wireline 13 suspended from a crane or mast (not shown) above a wellhead (not shown). Other means of transmitting data and commands, such as fiber optic cable, may also be used.

Figure 3:
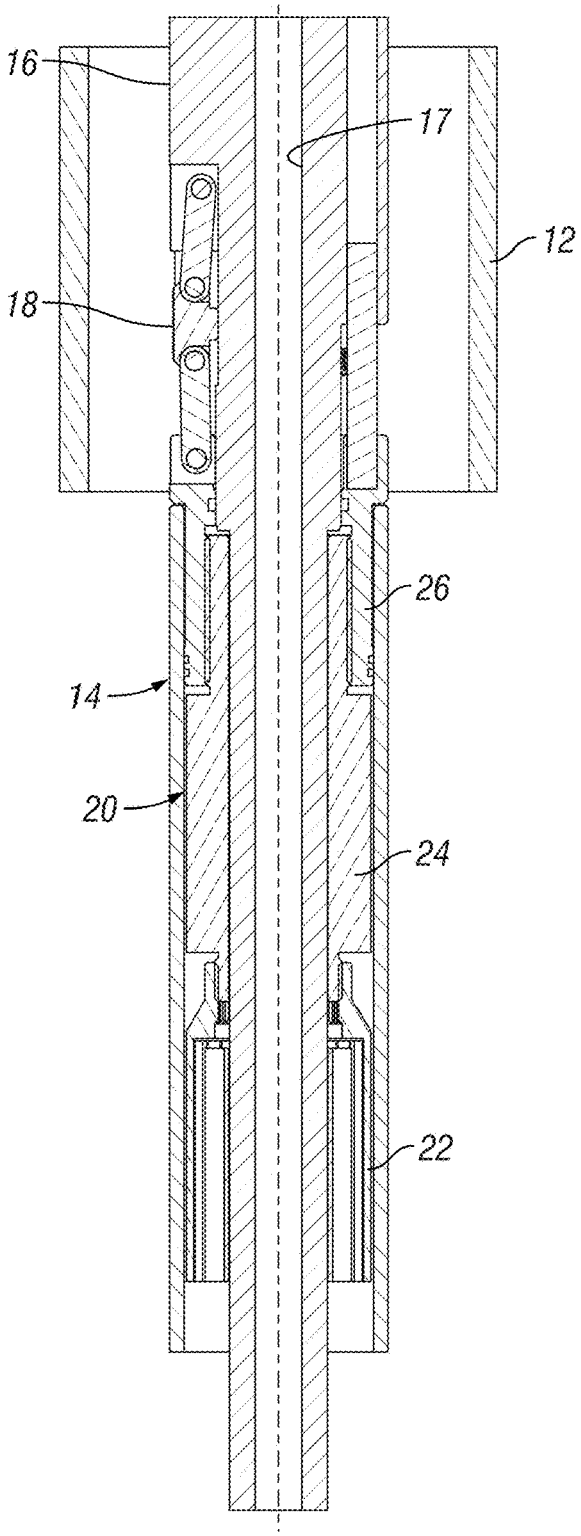
FIG. 3 shows a cross-section of a tool anchor according to one embodiment.

In one embodiment, the wellbore intervention tool 10 includes an anchor 14 for holding the wellbore intervention tool 10 in place during penetration of an obstruction. The anchor 14 may engage a wall of the wellbore 12, a casing or liner installed in the wellbore 12, or a tubing within the wellbore 12. In FIG. 3, an example embodiment of the anchor 14 includes an anchor body 16 on which a radially expandable anchor 18 is mounted. The anchor body 16 may have an axial bore 17 for passage of tools, fluids, and the like. The anchor 14 may include a drive mechanism 20 for sliding the radially expandable anchor 18 on the anchor body 16 in order to move the radially expandable anchor 18 between a collapsed position and an expanded position. The drive mechanism 20 may include, for example, a hollow motor 22, a reduction gear system 24, and a screw drive 26 mounted on the anchor body 16. The motor 22 may be, for example, an electrical, pneumatic, or hydraulic motor.

Returning to FIG. 1, the wellbore intervention tool 10 includes a cutting tool 30 for penetrating the obstruction 11 in the wellbore 12. The cutting tool 30 has one or more cutting members that can be placed against the obstruction 11 and used to grind, mill, and/or apply other cutting action to the obstruction 11. The cutting members may be blades, drill bits, and the like.

In one embodiment, the cutting tool 30 may be a dual-blade counter-rotating cutter. Such embodiments include the cutting tool 30 having two blades 31 (only one blade is visible in the drawing) mounted adjacent to each other with a gap between the blades 31 such that the blades 31 do not contact each other when rotating and a drive mechanism (not shown) for rotating the two blades 31 in opposite directions, typically about a common rotational axis (shown at 31A). The drive mechanism may be operated by a motor 42, such as an electrical motor, pneumatic motor, or hydraulic motor, included in the wellbore intervention tool 10. Introducing a counter-rotating cutting feature in the cutting tool 30 will improve the penetration speed and efficiency of the cutting tool 30, lower the amount of axial force (weight) needed to urge the cutting tool 30 against the obstruction, and significantly reduce the risk of "kickback" due to the blade of the cutting tool 30 becoming stuck, which would damage a wireline deployed tool.

An example of a dual-blade counter-rotating cutter is disclosed in U.S. Patent Application Publication No. 2013/0048329 filed by Qian (the '329 publication). A dual-blade counter-rotating cutter such as disclosed in the '329 publication or other similar device may be used as the cutting tool 30 in one embodiment.

In another embodiment, the cutting tool 30 may be a single-blade rotating cutter. In another embodiment, the cutting tool 30 may have more than two rotating blades. In another embodiment, the cutting tool 30 may be a drill bit.

In one embodiment, a pivoting mechanism 40 is coupled to the cutting tool 30 and may be used to adjust a cutting position of the cutting tool 30. As an example, the pivoting mechanism 40 may include a pivot pin 35 that the cutting tool 30 may pivot around. The cutting tool 30 may be coupled to the pivot pin 35 such that an offset angle of the cutting tool 30 relative to the tool axis 33 can be set by adjusting the rotational angle of the cutting tool 30 around the pivot pin 35. This movement may be independently controlled by a suitable rotary drive mechanism in the pivoting mechanism 40, such as an electric motor and a worm gear.

In one embodiment, the pivoting mechanism 40 is coupled to a sweeper 45, which is configured to rotate the pivoting mechanism 40 about the tool axis 33. The sweeper 45 may rotate the pivoting mechanism 40 through 360 degrees around the tool axis 33. The sweeper 45 may include, for example, an electrical or hydraulic motor and a gear or gear box. The cutting tool 30 is coupled to the pivoting mechanism 40 and will rotate with the pivoting mechanism 40.

In FIG. 1, the cutting tool 30 is aligned with the tool axis 33. The offset angle of the cutting tool 30 relative to the tool axis 33 is therefore 0 degrees. In this position, the rotation axis (shown at 31A) of the blade(s) 31 of the cutting tool 30 is substantially perpendicular to the tool axis 33. This will result in a cutting through the obstruction 11 with a diameter substantially the same as the diameter of the cutting blade(s) 31.

Figure 2:
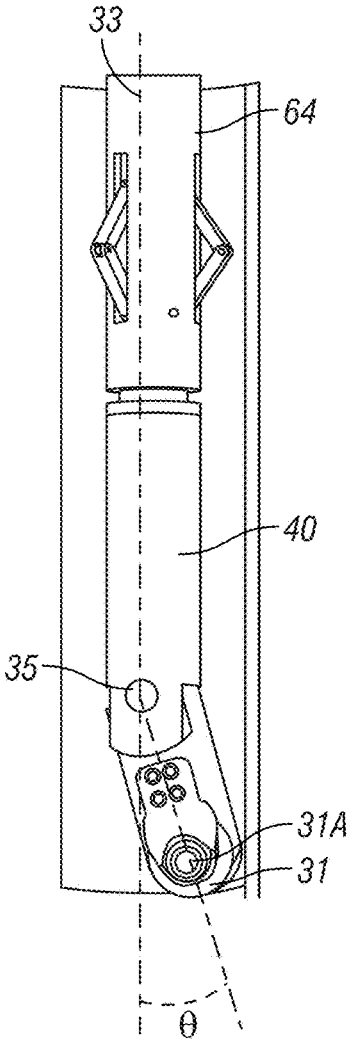
FIG. 2 shows a cutting tool pivoted relative to a tool axis according to one embodiment.

In FIG. 2, the cutting tool 30 is not aligned with the tool axis 33, and the offset angle θ of the cutting tool 30 relative to the tool axis 33 is therefore greater than 0 degrees. This will result in a cutting through the obstruction 11 with a larger diameter than the diameter of the cutting blade 31. The diameter of the cutting may be therefore determined by the amount of cutting tool axis angular offset. The pivoting function can be used, for example, to control the location and size of a "window" milled in a tubular.

Figure 2A:
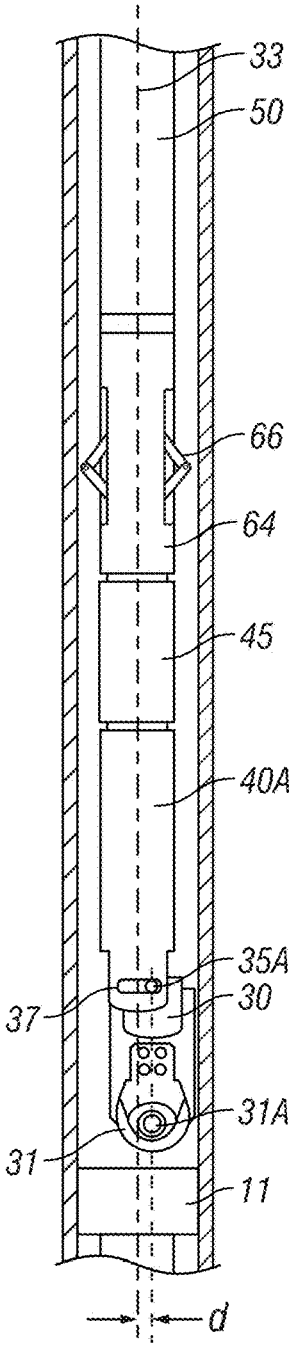
FIG. 2A shows a cutting tool laterally displaced relative to a tool axis according to one embodiment.

The pivoting mechanism 40 is an example of an angular displacement mechanism. In another embodiment, the pivoting mechanism 40 may be replaced with a linear displacement mechanism, such as illustrated at 40A in FIG. 2A. The linear displacement mechanism 40A may be operated to adjust an offset distance d of the cutting tool 30 relative to the tool axis 33. As an example, the linear displacement mechanism 40A may include a pin 35A that slides within a slot 37. The cutting tool 30 may be coupled to the pin 35A so that the offset distance d between the cutting tool 30 and the tool axis 33 can be adjusted by sliding the pin 35A within the slot 37. When the cutting tool 30 is aligned with the tool axis 33, the offset distance d will be zero. A suitable drive mechanism in the linear displacement mechanism 40A can be used to move the pin 35A within the slot 37. Also, the linear displacement mechanism 40A is not limited to a pin-and-slot arrangement and may generally include any arrangement that can be used to displace the cutting tool 30 relative to the tool axis 33. As in the case of the pivoting mechanism 40, the linear displacement mechanism 40A may be coupled to the sweeper 45 and rotated or deflected about the tool axis 33 by the sweeper 45.

It is also possible to have a displacement mechanism that selectively provides an angular or linear displacement to the cutting tool 30.

Returning to FIG. 1, in one embodiment, the wellbore intervention tool 10 may include a stroker 50 for applying an axial force (and movement) along the tool axis 33. Such an axial force can provide a downward/forward pressure on the cutting tool 30 to assist with the milling of an obstruction. The axial force may be transmitted to the cutting tool 30 through the pivoting mechanism 40 (or through the linear displacement mechanism 40A in FIG. 2A). During a window milling operation where the cutter blade(s) 31 may be moved radially substantially away from the tool axis 33. The stroker 50 may also generate an upward force/movement of the cutting tool 30.

Figure 4:
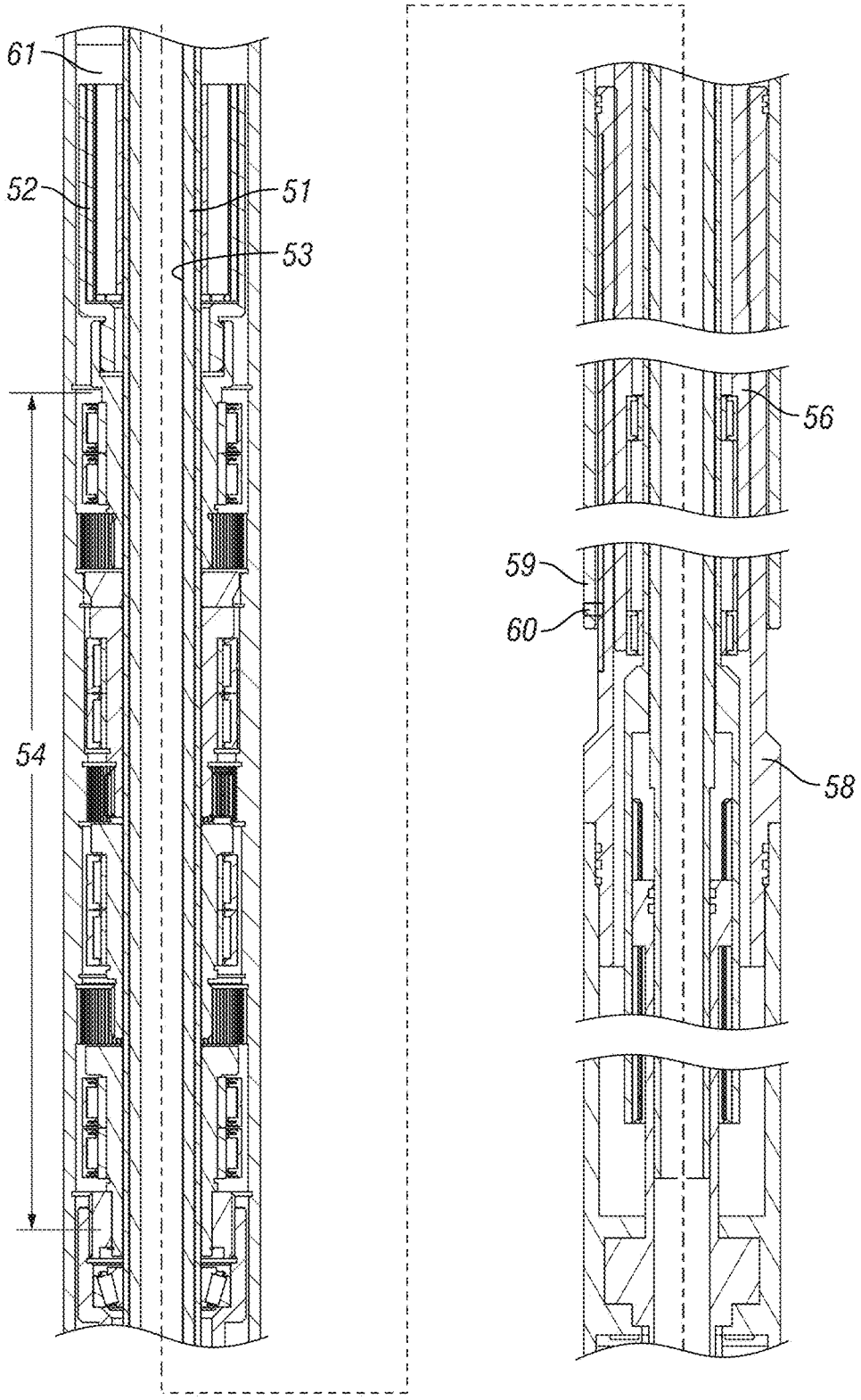
FIG. 4 shows a cross-section of a stroker according to one embodiment.

The stroker 50 may have any suitable configuration. In FIG. 4, an example stroker 50 includes a stroker body 51, which may have an axial bore 53 for passage of fluids, tools, and the like. Mounted on the stroker body 51 are a motor 52, which may be electrical, pneumatic, or hydraulic, a gear box 54, and a screw drive 56. A nut 58, e.g., a ball nut, cooperatively engages the screw drive 56. The screw drive 56 has an external thread section reaching from its lower end to a downward facing shoulder at its upper end. The nut 58 may have internal threads in its upper end engaged with the external threads of the screw drive 56. The nut 58 may have external axial key-slots where keys installed in the very lower end of the outer housing 59 are engaged and serve as an anti-rotation device 60. The motor 52, gear box 54, and screw drive 56 may be placed in a pressure balanced chamber 61 to keep them clean and functional.

Another example of a stroker that may be used in the wellbore intervention tool 10 is disclosed in U.S. Patent Application No. 2010/0126710 to Hallundbaek et al. (the '710 publication). In the '710 publication, the stroker includes a piston mounted on a shaft and disposed in a cylinder. The piston divides the cylinder into two chambers, each of which may be selectively filled with fluid from a pump. The piston moves along the cylinder in response to differential fluid pressure between these two chambers. As the piston moves, the shaft moves along with the piston and provides the desired axial force.

Returning to FIG. 1, in one embodiment, the wellbore intervention tool 10 may include a stabilizer section 64 for centralizing the wellbore intervention tool 10 in the wellbore 12 during penetration of an obstruction. Any suitable stabilizer known in the art of wellbore operations may be used. In general, the stabilizer section 64 may include, e.g., radial fins 66 and the like arranged about the diameter of the wellbore intervention tool 10. The radial fins 66 may be collapsible, for example, to allow passage of the tool 10 through restricted diameters within the wellbore 12.

The cuttings from the wellbore intervention tool 10 may be left in place, or a debris catching feature can be built into the wellbore intervention tool 10. In one embodiment, the debris catching feature may include circulating fluids through the cutting tool 30 into a so-called "junk basket" mounted externally or internally on the cutting tool 30 or in a module attached above the cutting tool 30.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A wellbore intervention tool for use in penetrating an obstruction in a wellbore, comprising:

a cutting tool having at least one rotating cutter member for penetrating the obstruction;

a displacement mechanism coupled to the cutting tool and operable to set and adjust a cutting position of the cutting tool relative to a tool axis;

a sweeper coupled to the displacement mechanism and operable to deflect the displacement mechanism about the tool axis, wherein the cutting tool is deflected with the displacement mechanism; and wherein the rotating cutter member has a rotation axis at all times substantially perpendicular to the tool axis.

2. The wellbore intervention tool of claim 1, wherein the sweeper is configured to rotate the displacement mechanism through 360 degrees around the tool axis.

3. The wellbore intervention tool of claim 1, wherein the displacement mechanism is configured to set and adjust an offset angle between the cutting tool and the tool axis.

4. The wellbore intervention tool of claim 1, wherein the displacement mechanism is configured to set and adjust an offset distance between the cutting tool and the tool axis.

5. The wellbore intervention tool of claim 1, wherein the at least one rotating cutter member is a rotating cutting blade.

6. The wellbore intervention tool of claim 5, wherein the cutting tool comprises two counter-rotating cutting blades.

7. The wellbore intervention tool according to claim 1, wherein the at least one rotating cutter member is a drill bit.

8. The wellbore intervention of claim 1, further comprising a stroker for applying an axial force along the tool axis, wherein the stroker is coupled to the cutting tool such that the applied axial force exerts a downward pressure on the cutting tool.

9. The wellbore intervention tool of claim 1, further comprising a motor for rotating the at least one rotating cutter member.

10. The wellbore intervention of claim 1, further comprising an anchor for holding the wellbore intervention tool in place in the wellbore during penetration of the obstruction using the cutting tool.

11. The wellbore intervention tool of claim 1, further comprising a stabilizer for centralizing the wellbore intervention tool in the wellbore.

12. The wellbore intervention tool of claim 1, which is suspended on an end of a wireline or a coiled tubing having an electrical cable.

13. The wellbore intervention tool of claim 1, which is suspended conveyance, wherein the conveyance comprises an end of a fiber optic cable.

14. A method of penetrating an obstruction in a wellbore, comprising:

lowering a wellbore intervention tool into a wellbore, the wellbore intervention tool comprising a cutting tool having at least one rotating cutter member, a displacement mechanism coupled to the cutting tool, and a sweeper coupled to the displacement mechanism;

positioning the least one rotating cutter member against the obstruction;

rotating the at least one rotating cutter member while the at least one rotating cutter member is positioned against the obstruction wherein the rotating cutter member has a rotation axis at all times substantially perpendicular to a tool axis; and operating the sweeper to deflect the displacement mechanism about the tool axis during at least a portion of the rotating the at least one rotating cutter member.

15. The method of claim 14, further comprising operating the displacement mechanism to adjust the cutting tool to a select cutting position relative to the tool axis.

16. The method of claim 15, wherein operating the displacement mechanism comprises pivoting the cutting tool to a select offset angle relative to the tool axis.

17. The method of claim 15, wherein operating the displacement mechanism comprises linearly displacing the cutting tool to a select offset distance from the tool axis.

18. The method of claim 14, wherein operating the sweeper to deflect the displacement mechanism comprises operating the sweeper to rotate the displacement mechanism about the tool axis.

19. The method of claim 14, further comprising applying a downward or forward force to the cutting tool during at least a portion of rotating the at least one rotating cutter member.

20. The method of claim 14, further comprising anchoring the wellbore intervention tool in the wellbore during the rotating the at least one rotating cutter member.

* * * * *